US007523984B2

(12) United States Patent
Steininger

(10) Patent No.: US 7,523,984 B2
(45) Date of Patent: Apr. 28, 2009

(54) RECONFIGURABLE INFANT ACTIVITY CENTER

(75) Inventor: Jeffrey Steininger, St. Marys, OH (US)

(73) Assignee: Evenflo Company, Inc., Miamisburg, OH (US)

( * ) Notice: Subject to any disclaimer, the term of this patent is extended or adjusted under 35 U.S.C. 154(b) by 0 days.

(21) Appl. No.: 11/712,226

(22) Filed: Feb. 28, 2007

(65) Prior Publication Data

US 2007/0236056 A1 Oct. 11, 2007

Related U.S. Application Data

(60) Provisional application No. 60/777,613, filed on Feb. 28, 2006.

(51) Int. Cl.
*A47D 1/02* (2006.01)
*B62M 1/00* (2006.01)
*A63H 33/00* (2006.01)

(52) U.S. Cl. ..... 297/16.1; 446/227; 280/87.05; 280/87.051

(58) Field of Classification Search ..... 297/16.1; 446/227; 280/87.05, 87.051
See application file for complete search history.

(56) References Cited

U.S. PATENT DOCUMENTS 3,796,430 A 3/1974 Sudo
4,025,083 A 5/1977 Saint
4,171,132 A * 10/1979 Kassai ..... 280/87.05
4,171,847 A 10/1979 Tukui
4,226,467 A 10/1980 Boudreau
4,699,392 A * 10/1987 Ku ..... 280/87.051
4,773,639 A * 9/1988 Graves ..... 482/66
5,035,013 A 7/1991 Bloom
5,088,139 A 2/1992 Bloom
5,104,180 A 4/1992 Takahashi et al.
D335,060 S 4/1993 Dial
5,211,607 A * 5/1993 Fermaglish et al. ..... 472/15
5,241,716 A 9/1993 Kohus
5,302,163 A * 4/1994 Fermaglich et al. ..... 482/66
5,370,460 A 12/1994 Nelson
5,380,262 A 1/1995 Austin
D355,939 S 2/1995 Meeker et al.
5,407,246 A 4/1995 Meeker et al.
5,433,682 A * 7/1995 Fermaglich et al. ..... 482/66
5,451,093 A * 9/1995 Petrie et al. ..... 297/137
5,478,268 A 12/1995 Au
5,491,851 A 2/1996 Alonso
D369,685 S 5/1996 Meeker et al.
5,518,475 A 5/1996 Garland (Continued)

*Primary Examiner*—Rodney B. White
(74) *Attorney, Agent, or Firm*—Taft Stettinius & Hollister LLP

(57) ABSTRACT

An infant activity center comprising: (a) an infant-activity center tray having an infant seat; (b) a ring having a cushion extending across the diameter of the ring; and (c) a plurality of repositionable pylons concurrently mounted to the ring and the tray, the repositionable pylons being repositionable between a use position and a storage position, wherein the distance between the tray and the cushion is greater when the pylons are in the use position than in the storage position, and wherein each of the pylons cooperates with the ring to form a biased latch securing each pylon in at least the use position or the storage position, and wherein at least one of the cushion and the ring includes a catch operative to interact with the tray to secure the pylons in the storage position.

13 Claims, 6 Drawing Sheets

U.S. PATENT DOCUMENTS

D371,266 S 7/1996 Ward
5,544,372 A 8/1996 Garland et al.
5,546,620 A 8/1996 Matthews
D375,984 S 11/1996 Burns
5,581,827 A 12/1996 Fong et al.
D378,554 S 3/1997 Meeker et al.
D383,912 S 9/1997 Meeker et al.
5,688,211 A * 11/1997 Myers ..... 482/66
5,700,201 A 12/1997 Bellows et al.
5,704,576 A 1/1998 Meeker et al.
D390,888 S 2/1998 Meeker et al.
D391,309 S 2/1998 Meeker et al.
5,728,030 A * 3/1998 Hsieh ..... 482/66
5,779,386 A 7/1998 Eichhorn
5,785,383 A 7/1998 Otero
5,788,253 A 8/1998 Thomson et al.
5,813,948 A 9/1998 Quigg et al.
5,839,706 A 11/1998 Liu
D408,192 S 4/1999 Chiang
5,928,054 A 7/1999 Mast
5,934,747 A * 8/1999 Garland ..... 297/136
5,937,461 A 8/1999 Dombrowski et al.
5,970,541 A 10/1999 Chiang
5,971,611 A 10/1999 Rosengren
5,971,761 A 10/1999 Tillman, Sr.
6,000,750 A * 12/1999 Rossman et al. ..... 297/2
6,041,455 A 3/2000 Raffo et al.
6,048,290 A * 4/2000 Chen et al. ..... 482/68
6,066,022 A 5/2000 Fobean et al.
6,128,794 A 10/2000 Pariseau
6,179,376 B1 1/2001 Meeker et al.
6,299,247 B1 10/2001 Meeker et al.
D450,782 S 11/2001 Chan
D451,970 S 12/2001 Chan
6,332,824 B2 12/2001 Tell et al.
D455,181 S 4/2002 Moffett, III et al.
6,408,463 B1 6/2002 Palacio
6,517,151 B2 2/2003 Liu
6,574,810 B2 6/2003 Mangiaracina
6,702,643 B1 3/2004 Drosendahl et al.
6,715,826 B2 4/2004 Bellows et al.
6,742,749 B2 6/2004 Kassai et al.
6,817,864 B1 * 11/2004 Martinez ..... 434/258
6,854,799 B1 2/2005 Asbach et al.
D503,063 S 3/2005 Bartle et al.
6,863,287 B2 3/2005 Myers et al.
6,896,575 B2 5/2005 Fair et al.
7,025,364 B1 * 4/2006 Clarke ..... 280/87.051
7,287,768 B2 * 10/2007 Myers et al. ..... 280/87.051
2004/0075231 A1 * 4/2004 Hou et al. ..... 280/87.051
2008/0113581 A1 * 5/2008 Jazenski et al. ..... 446/227

* cited by examiner

Fig. 4
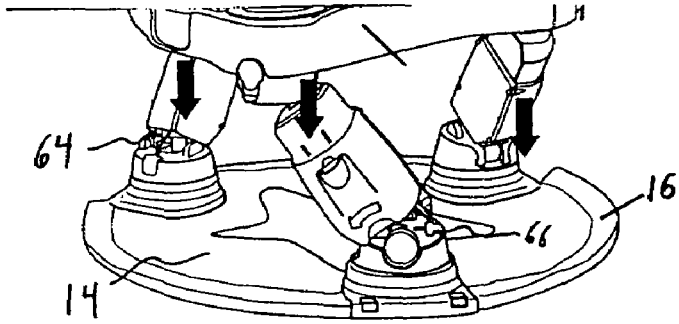
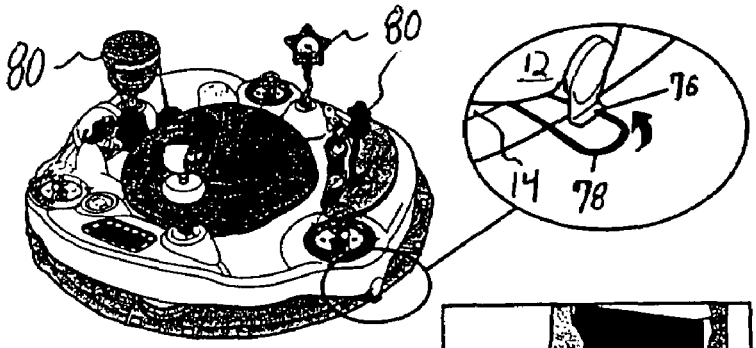
Fig. 5
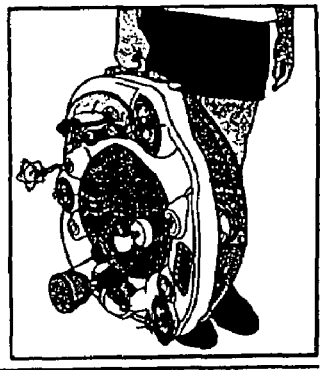
Fig. 6
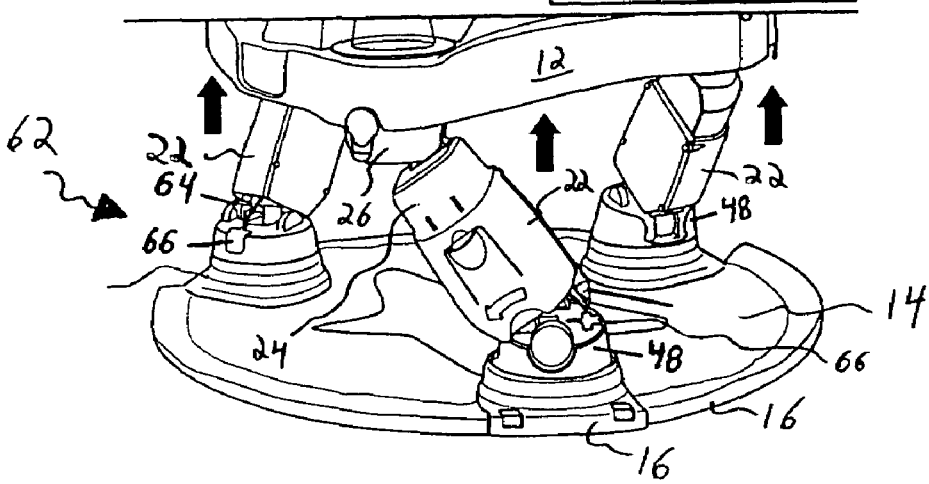
Fig. 3

RECONFIGURABLE INFANT ACTIVITY CENTER

CROSS-REFERENCE TO RELATED APPLICATION

This application claims the benefit of U.S. Patent Application Ser. No. 60/777,613, filed Feb. 28, 2006, entitled "RECONFIGURABLE INFANT ACTIVITY CENTER", the disclosure of which is incorporated herein by reference.

BACKGROUND

Field of the Invention

The present invention is directed to infant activity centers, and more particularly to an infant activity center which is foldable.

SUMMARY

The present invention is directed to an infant activity center including an infant-activity-center tray, a ring, a cushion, and a plurality of substantially-rectilinear pylons. Each of the pylons has a lower portion that is directly or indirectly rotatably attached to the base and each of the pylons has an upper portion that is directly or indirectly rotatably attached to the tray enabling the tray and the ring to be relatively rotated and folded from a use position to a storage position The distance between the tray and the base is greater in the use position than in the storage position. Each of the pylons is substantially vertical when the tray and the ring are in the use position.

It is a first aspect of the present invention to provide an infant activity center comprising: (a) an infant-activity center tray having an infant seat; (b) a ring having a cushion extending across the diameter of the ring; and (c) a plurality of repositionable pylons concurrently mounted to the ring and the tray, the repositionable pylons being repositionable between a use position and a storage position, wherein the distance between the tray and the cushion is greater when the pylons are in the use position than in the storage position, and wherein each of the pylons cooperates with the ring to form a biased latch securing each pylon in at least the use position or the storage position, and wherein at least one of the cushion and the ring includes a catch operative to interact with the tray to secure the pylons in the storage position.

In a more detailed embodiment of the first aspect, the tray is rotated either clockwise or counterclockwise with respect to the ring to rotate and fold the tray from the use position to the storage position. In yet another more detailed embodiment, each pylon is injection molded. In a further detailed embodiment, the plurality of pylons include three or more pylons. In still a further detailed embodiment, each of the pylons is perpendicular to the tray and ring when in the use position. In a more detailed embodiment, each of the pylons is substantially parallel to the tray and ring when in the storage position.

It is a second aspect of the present invention to provide an infant activity center comprising: (a) an infant-activity-center tray having an infant-receiving opening; a ring having a cushion distributed about the interior thereof; and (b) a plurality of connecting arms concurrently mounted to the tray and the ring, each of the connecting arms being rotationally repositionable and vertically repositionable with respect to the tray and the ring.

In yet another more detailed embodiment of the second aspect, the ring comprises semicircular metal frame members interconnected by polymer mounts that connect to the connecting arms. In still another more detailed embodiment, the cushion comprises a fabric bag filled with stuffing. In a further detailed embodiment, the cushion is extractable from the ring to facilitate replacement of the cushion without complete disassembly of the infant activity center.

It is a third aspect of the present invention to provide a An infant activity center comprising: (a) an infant-activity-center tray having an infant seat and a cushion disposed underneath the infant seat; (b) a plurality of connecting arms to support the tray, each of the connecting arms being rotationally repositionable and vertically repositionable with respect to the tray; and (c) a plurality of shock absorbers interposing the tray and the plurality of connecting arms to provide a vertical range of movement relative to the tray and the connecting arms.

It is a fourth aspect of the present invention to provide a method of constructing an infant activity center, the method comprising the steps of: (a) mounting a plurality of supports to an infant tray, the supports being at least one of rotationally and vertically adjustable with respect to the infant tray; (b) mounting the plurality of supports to a ring, the ring having a cushion across the interior thereof, where the plurality of supports are at least one of rotationally and vertically adjustable with respect to the ring; (c) positioning a cushion underneath the infant tray and mounting the cushion to at least one of the plurality of supports, the ring, and the infant tray; (d) locking the plurality of supports to inhibit rotational adjustment with respect to the infant tray; and (e) locking the plurality of supports to inhibit vertical adjustment with respect to the ring.

It is a fifth aspect of the present invention to provide a method of constructing an infant activity center, the method comprising the steps of: (a) mounting a plurality of supports to an infant tray, the supports being at least one of rotationally and vertically adjustable with respect to the infant tray; (b) mounting the plurality of supports to a ring, where the plurality of supports are at least one of rotationally and vertically adjustable with respect to the ring; (c) mounting a cushion to the ring to retain the cushion in position with respect to the ring; (d) orienting the infant tray to substantially overlap the ring and cushion; (e) locking the plurality of supports to inhibit rotational adjustment with respect to the infant tray; and (f) locking the plurality of supports to inhibit vertical adjustment with respect to the ring.

BRIEF DESCRIPTION OF THE DRAWINGS

FIG. 3 is an elevated profile view of the pylons repositioned to erect the embodiment of FIG. 1;

FIG. 4 is an elevated profile view of the pylons repositioned to collapse the embodiment of FIG. 1;

FIG. 5 is an elevated perspective view of the infant activity center of FIG. 1 in the collapsed position;

FIG. 6 is an elevated perspective view of the infant activity center of FIG. 1 in the collapsed position and oriented on its side;

DETAILED DESCRIPTION

The exemplary embodiments of the present invention are described and illustrated below to encompass infant activity centers and methods of reconfiguring infant activity centers. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Figure 2:
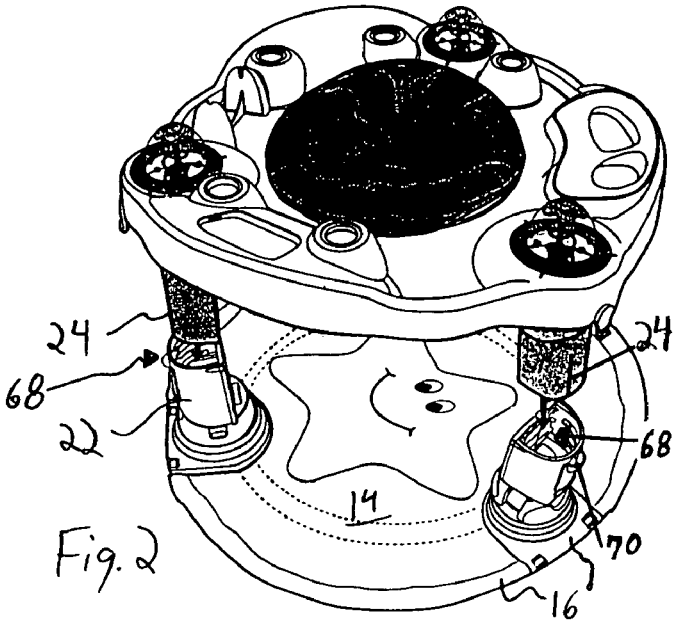
FIG. 2 is an elevated perspective view of the infant activity center of FIG. 1 with the pylons in an exploded view.
Figure 1:
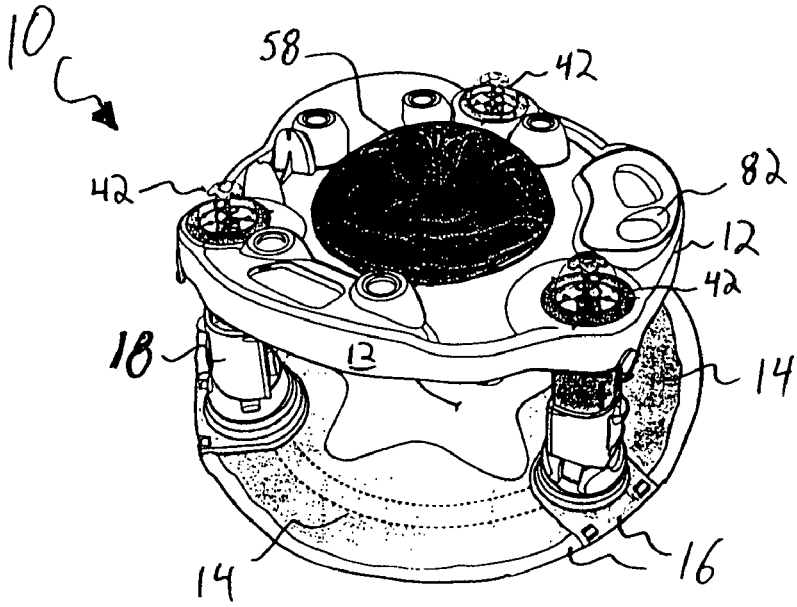
FIG. 1 is an elevated perspective view of an exemplary infant activity center embodiment of the present invention.

Referencing FIGS. 1 and 2, an infant activity center 10 includes an infant-activity-center tray 12, a cushion bottom 14, a ring 16, and a plurality of substantially-rectilinear pylons 18, collectively cooperating to define a perimeter around an infant-receiving opening within the center tray 12. Each pylon 18 includes a lower portion 22 that is directly or indirectly rotatably attached to the ring 16 and an upper portion 24 that is directly or indirectly rotatably attached to the tray 12. In this manner, the tray 12 and the ring 16 can be rotated with respect to one another and the pylons 18 folded to move the infant activity center 10 between a use position (see FIGS. 1 and 14) and a storage position (see FIGS. 5 and 6). Typically, the ring 16 is supported by on the floor or level ground in the use position so that each pylon 18 is within thirty degrees of vertical. In this exemplary embodiment, the tray 12 is rotated either clockwise or counterclockwise with respect to the ring 16 to fold and unfold the pylons 18 allowing the tray 12 to move between a collapsed position (storage position) and an erected position (use position).

Figure 8:
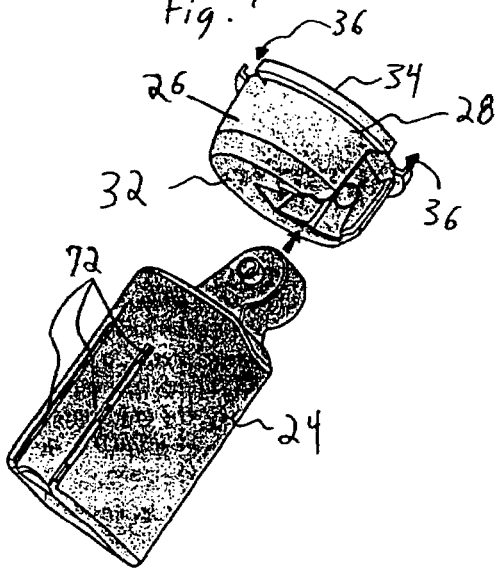
FIG. 8 is an elevated perspective view of a segment of the exemplary pylon and connecting member of FIG. 1.
Figure 9:
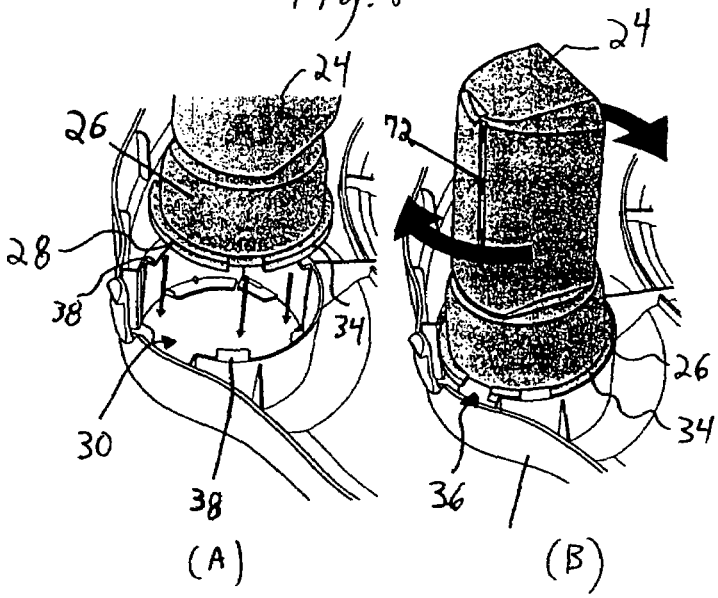
FIG. 9 is an underside perspective view of a segment of the exemplary pylon, connecting member, and tray of FIG. 1.

Referring to FIGS. 8 and 9, each pylon 18 is mounted to the tray 12 via an intervening upper connecting member 26. A first end 28 of each intervening upper connecting member 26 is generally circular in cross-section and rotationally repositionable along a first rotational axis with respect to a cylindrical cavity 30 formed within the underside of the tray 12, while an opposing end 32 of the intervening upper connecting member 26 is pivotally mounted to the upper portion 24 along a first vertical axis, generally perpendicular to the first rotational axis. The first end 28 of each intervening upper connecting member 26 includes a circumferential L-shaped flange 34 having three notches 36 that are adapted to allow vertical throughput of three corresponding prongs 38 horizontally extending from the cylindrical cavity 30 of the tray 12. When the notches 36 are vertically aligned with the prongs 38, the first end 28 can be vertically positioned within the cylindrical cavity 30 and secured within the cavity by rotating the connecting member 26 so that the L-shaped flange 34 rides on top of the notches 36 (see FIG. 9(B)).

Figure 10:
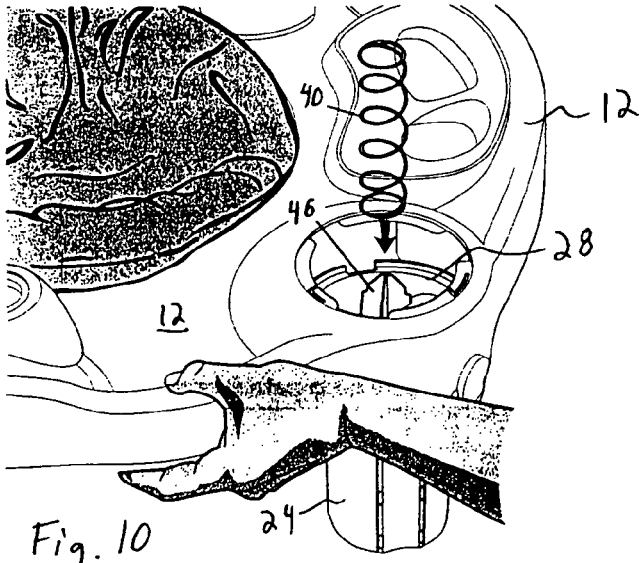
FIG. 10 is a partial exploded view of the exemplary shock absorbing structure of the instant invention.
Figure 11:
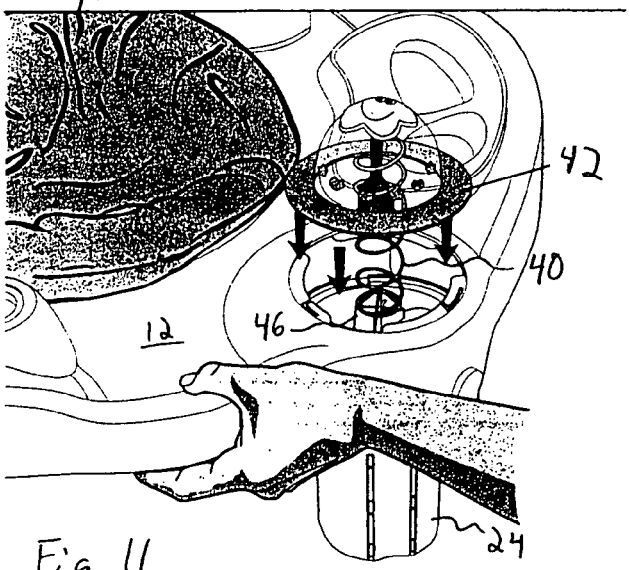
FIG. 11 is an exploded view of the exemplary shock absorbing structure of the instant invention.
Figure 12:
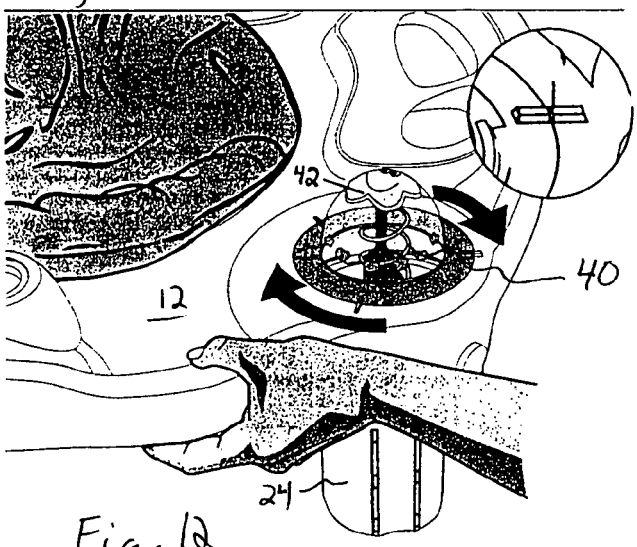
FIG. 12 is constructed view of the exemplary shock absorbing structure of the instant invention.

Referencing FIGS. 10-12, a spring 40 is wedged between the top 28 of the intervening upper connecting member 26 and a removeable dome 42 mounted to the top of the tray 12. The concave portion of the dome 42 includes a cup (not shown) that receives one end of the spring 44, while the top 28 of the intervening upper connecting member 26 includes a vertical cross 46 that is received within an opposing end of the spring 40 so that the spring circumscribes the cross. In this manner, the bias of the spring 40 directs the tray 12, by way of the removable dome connected thereto, away from the corresponding intervening upper connecting member 26.

Figure 7:
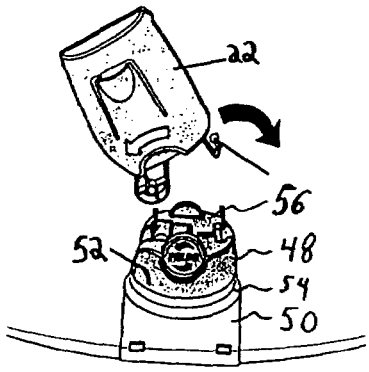
FIG. 7 is an elevated perspective view of a segment of the exemplary pylon, connecting member, and ring of FIG. 1.

Referring to FIG. 7, the lower portion 22 of each pylon 18 is attached a lower intervening member 48 that is mounted to a platform 50 of the ring 16. Each lower intervening member 48 includes a first end 52 that is rotationally mounted to the top 54 of the platform 50 along a rotational axis, while an opposing end 56 of the lower intervening member 48 is pivotally mounted to the lower portion 22 along a second vertical axis, generally perpendicular to the second rotational axis.

Referring again to FIGS. 1 and 2, a seat 58 is disposed in the infant-receiving opening and attached to the tray 12. In exemplary form, the seat 58 is rotatable to allow the infant to turn along a center axis relative to the tray 12. Moreover, the tray 12, and accordingly the seat 58, is vertically repositionable with respect to the pylons 18 when the pylons are in the use position by way of movement between the intervening upper connecting members 26 and the tray 12. Each corresponding spring 40, removable dome 42, and top 28 of the intervening upper connecting member 26 cooperate to provide a shock absorber that absorbs the weight of an infant in the seat 58. In a typical condition, the weight of the infant will not fully compress the spring 40, thereby allowing bouncing by the infant as can be appreciated by those skilled in the art.

Referencing FIGS. 3 and 7, each pylon 18 includes a latch 62 for locking the orientation of the pylon with respect to the ring 16 and tray 12. In this manner, rotation of the tray 12 with respect to the ring 16 is inhibited when the longitudinal aspect of the pylon 18 is concurrently perpendicular to the tray 12 and ring 16, synonymous with the use position. The latch 62 includes a biased detent 64 mounted to the lower portion 22 of each pylon 18 that is received within a recess 66 formed within the lower intervening member 48. The line of travel of the detent 64 contacts the boundary of the recess 66 and retains the detent therein, alternatives of which are well known to those skilled in the art. With the detent 64 captured within the recess 66, the corresponding pylon 18 is vertically oriented so that the length of the pylon is generally perpendicular to the tray 12 and ring 16 (see FIG. 1).

In operation, a user desiring to change the infant activity center 10 from the use position (seen in FIGS. 1-2) to the storage position (seen in FIGS. 5 and 6) must reposition the biased detent 64 of the latch 62 with respect to the recess 66 to manipulate the line of travel of the detent, thereby allowing the pylon 18 to be folded and approximate a horizontal position generally parallel to the tray 12 and ring 16. Thereafter, the user can then rotate the tray 12 slightly with respect to the ring 16 about the center axis and push the tray 12 toward the ring 16 until the storage position is reached or no further folding is possible.

Figure 13:
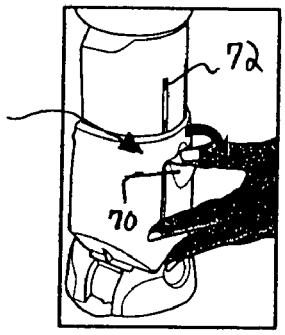
FIG. 13 is an elevated perspective view of an exemplary pylon and connecting member of FIG. 1.

Referencing FIGS. 2, 8, and 13, each pylon 18 includes fixed height adjustability, outside of that provided by the interaction between the intervening upper connecting member 26 and the tray 12. Each lower portion 22 includes a hollow cavity 68 that receives the solid portion of the upper portion 24, thereby allowing the upper portion 24 to move within the cavity 68 and change the overall length of the pylon 18. The lower portion 22 includes a biased catch 70 that is received within one of a set of three vertically spaced openings 72 within the upper portion 24. In this exemplary embodiment, the vertically spaced openings 72 include three separately spaced openings to provide incremental fixed height adjustability of the pylon 18. In operation, the user would withdraw the catch 70 from one of the three openings 72, thereby moving the catch 68 out of the line of travel of the openings 72 and allowing the upper portion 24 to move within the hollow cavity 68 of the lower portion 22. The user would then approximate the desired length of the pylon 18 and reposition the catch 70 into one of the openings 72 that most closely approximates the desired pylon length. The biased nature of the catch 70 will operate to retain the catch with the desired opening 72 until the user overcomes the bias to reposition the catch and adjust the overall length of the pylon 18. It is envisioned that this adjustment in the overall length of the pylon accommodates infants of various sizes, as well as adjusts to the same infant as the infant grows.

Figure 14:
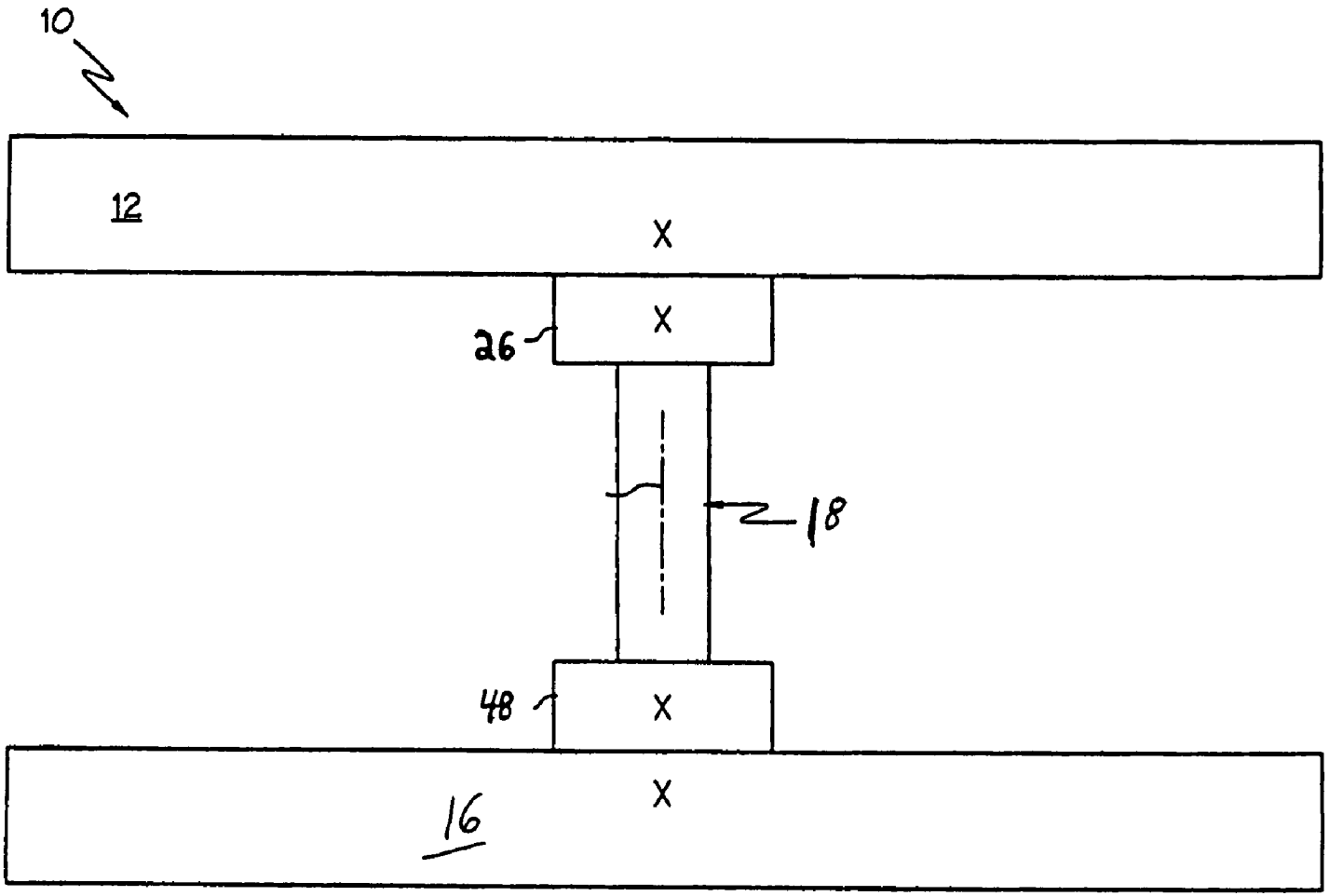
FIG. 14 is a representational view of some of the components of FIG. 1, with an "X" marking locations on various components before such components undergo rotation and folding to enable the infant activity center to be changed from its use configuration to its storage configuration.
Figure 15:
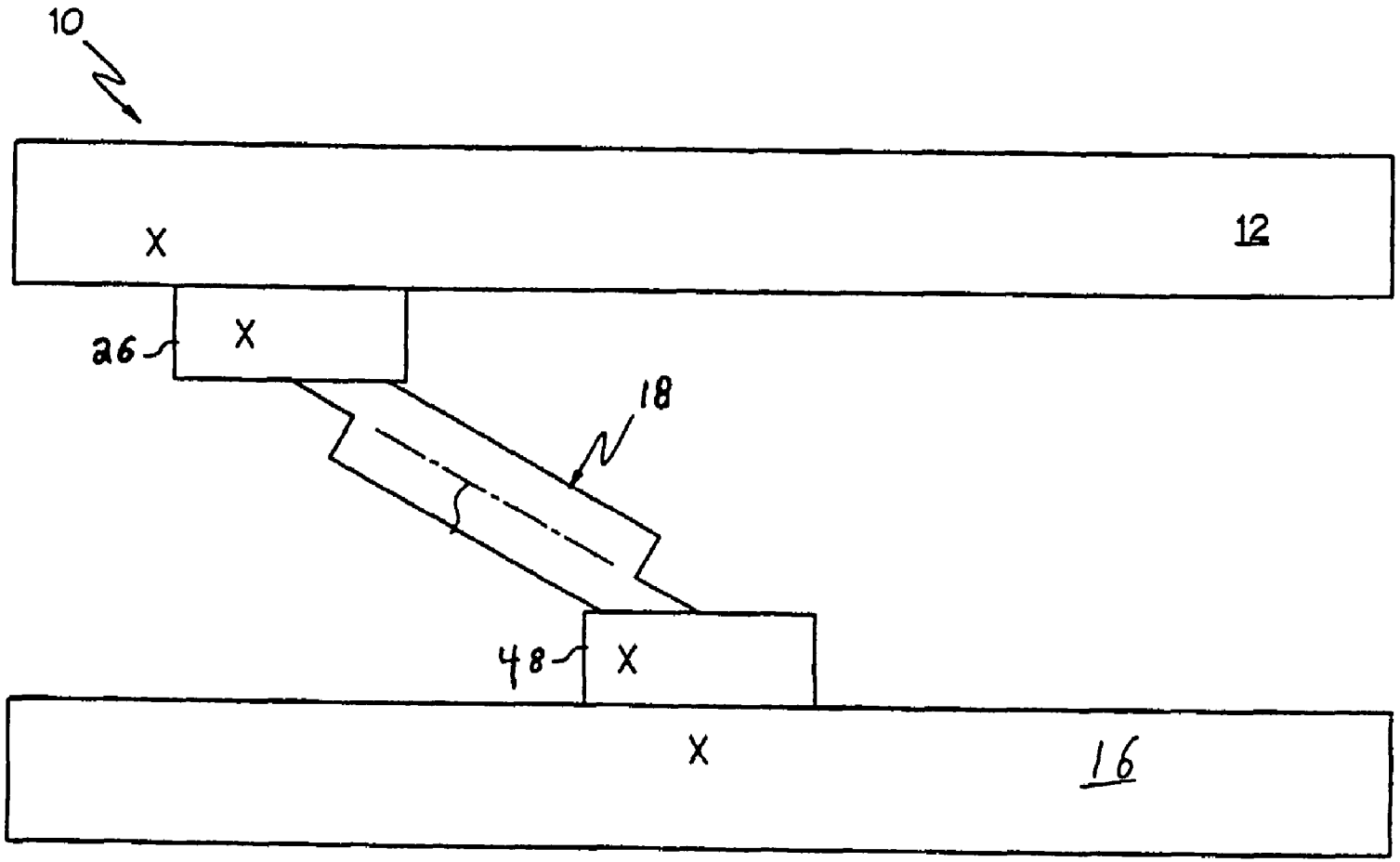
FIG. 15 is a representational view of some of the components of FIG. 1, with an "X" marking locations on various components after such components undergo rotation and folding to enable the infant activity center to be changed from its use configuration to its storage configuration.

FIGS. 14 and 15 are simple diagrams representing how the general orientation of the primary components 12, 16, 18, 26, 48 of the exemplary infant activity center 10 change relative to one another as the components are repositioned between the storage position and the use position (see also FIG. 3). The components each have been marked with an "X", where the "Xs" are vertically and rotationally aligned when the activity center 10 is in the use position (see FIG. 14), but are not vertically or rotationally aligned when the activity center 10 is in the storage position (see FIG. 15).

Referring to FIG. 5, a series of hooks 76 are circumferentially distributed about the perimeter of the tray and engage with corresponding elastic hoops 78 mounted to the cushion bottom 14 to allow the tray 12 and the ring 16 to remain in the storage position when the infant activity center 10 is standing on its side (see FIG. 6). To return the infant activity center 10 to its use position, with the ring 16 placed on the floor or level ground and any optional hook and notch arrangement unhooked, the user lifts and counter-rotates the tray 12 with respect to the ring 16 until the detent 64 of each latch 60 automatically and lockingly engages its corresponding recess 66 (see FIG. 3).

In the same or a different variation of the infant activity center 10, various play objects 80 such as toys and mirrors are attached to the tray 12. In the same or a different variation, the tray 12 includes other objects such as a cup holder 82, a crayon receptacle, etc.

Each pylon 18 is injection molded using a plastic material such as, without limitation, polyethylene or polypropylene. Similarly, the tray 12 and the platform component 50 of the ring 16 can also be injection molded using a polymer material. Moreover, each intervening upper connecting member 26 and each intervening lower connecting member 48 can also be fabricated using an injection molding process by molding polymer components. In sum, each of the aforementioned exemplary components may be fabricated using a plastic injection molding process, however, components such as the spring 40 are preferable fabricated from metals. It is to be understood, however, that other materials suitable for the functionality of the instant components could be substituted in lieu of the polymer components such, without limitation, woods, composites, ceramics, or metals.

It is also within the scope of the invention to have the lower portion 22 of one or more pylons 18 being rotatably attached to the ring 16 using a ball and socket joint (not shown) and/or the upper portion 24 of one or more pylons 18 being rotatably attached to the tray 12 using a ball and socket joint (not shown). An exemplary variation of the foregoing includes providing a lower portion 22 and an upper portion 24 of the pylon 18 that are repositionable in at least two axes of rotation, though not necessarily by way of a ball and socket joint.

While the aforementioned exemplary embodiment 10 has been described as having three pylons 18, it is also within the scope of the invention to have more than, or less than, three pylons 18. Likewise, while the three pylons 18 of the exemplary embodiment have been shown as being equidistant from one another, it is also within the scope of the invention that one or more of these pylons (or other pylons where more three pylons are utilized) may be more closely spaced to one another or farther spaced from one another than other reference pylons.

It is also within the scope of the present invention to mount wheels to the ring 16, thereby allowing the infant activity center 10 to be made portable by the movements of the infant.

As used herein, the term "infant" includes a baby, an infant, and a child. The terminology "infant activity center" includes, without limitation, infant walkers, infant exercisers, infant bouncers, infant toy centers, infant eating centers, etc.

It should be noted that as used herein, the term "attached" includes directly attached and includes indirectly attached, as can be appreciated by those skilled in the art. It is further noted that the terms "lower" and "upper" are used merely for differentiation and describe relative positioning in the use position, but not necessarily in the storage position.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. An infant activity center comprising:

an infant-activity center tray having an infant seat;

a substantially rigid ring circumscribing an open interior having a diameter;

a cushion extending across the diameter of the ring; and a plurality of repositionable pylons concurrently mounted to the ring and the tray, the repositionable pylons being repositionable between a use position and a storage position, wherein the distance between the tray and the cushion is greater when the pylons are in the use position than in the storage position, and wherein each of the pylons cooperates with the ring to form a biased latch securing each pylon in at least the use position or the storage position, and wherein at least one of the cushion and the ring includes a catch operative to interact with the tray to secure the pylons in the storage position;

wherein the substantially rigid ring has a generally circular shape and comprises at least two interconnected segments, each segment forming a portion of the circular shape;

wherein each of the pylons is mounted to the ring by a polymer mount; and wherein each of the pylons remains mounted to both the ring and the tray in both the storage position and the use position.

2. The infant activity center of claim 1, wherein the tray is rotated either clockwise or counterclockwise with respect to the ring to rotate and fold the tray from the use position to the storage position.

3. The infant activity center of claim 1, wherein each pylon is injection molded.

4. The infant activity center of claim 1, wherein the plurality of pylons includes three or more pylons.

5. The infant activity center of claim 1, wherein each of the pylons is perpendicular to the tray and ring when in the use position.

6. The infant activity center of claim 1, wherein each of the pylons is substantially parallel to the tray and ring when in the storage position.

7. An infant activity center comprising:

an infant-activity-center tray having an infant-receiving opening;

a substantially rigid ring circumscribing an open interior and having a cushion distributed about the interior thereof; and a plurality of connecting arms concurrently mounted to the tray and the ring, each of the connecting arms being rotationally repositionable and vertically repositionable with respect to the tray and the ring;

wherein each of the connecting arms includes at least two segments and a catch, the segments being longitudinally slidable relative to each other when the catch is disengaged and the segments being fixed relative to each other when the catch is engaged;

wherein the substantially rigid ring has a generally circular shape and comprises at least two interconnected segments, each segment forming a portion of the circular shape; and wherein each of the connecting arms is mounted to the ring by a polymer mount.

8. The infant activity center of claim 7, wherein the ring comprises semicircular metal frame members interconnected by the polymer mounts that connect to the connecting arms.

9. The infant activity center of claim 7, wherein the cushion comprises a fabric bag filled with stuffing.

10. The infant activity center of claim 9, wherein the cushion is extractable from the ring to facilitate replacement of the cushion without complete disassembly of the infant activity center.

11. An infant activity center comprising:

an infant-activity-center tray having an infant seat and a cushion disposed underneath the infant seat;

a plurality of connecting arms to support the tray, each of the connecting arms being rotationally repositionable and vertically repositionable with respect to the tray; and a plurality of shock absorbers interposing the tray and the plurality of connecting arms to provide a vertical range of movement relative to the tray and the connecting arms;

wherein a substantially rigid ring having generally circular shape and comprising at least two interconnected partially circular segments is coupled to the plurality of connecting arms proximate a lower end of each of the plurality of connecting arms by a respective polymer mount; and wherein each of the connecting arms includes at least two segments and a catch, the segments being longitudinally slidable relative to each other when the catch is disengaged and the segments being fixed relative to each other when the catch is engaged.

12. A method of constructing an infant activity center, the method comprising the steps of:

mounting a plurality of supports to an infant tray, the supports being rotationally and vertically adjustable with respect to the infant tray;

assembling a generally circular substantially rigid ring having an open interior by interconnecting a plurality of partially circular segments and attaching at least two polymer mounts;

mounting each of the plurality of supports to a respective one of the polymer mounts, where the plurality of supports are rotationally and vertically adjustable with respect to the ring;

positioning a cushion underneath the infant tray at least partially occupying the open interior of the ring and mounting the cushion to at least one of the plurality of supports, the ring, and the infant tray;

locking the plurality of supports to inhibit rotational adjustment with respect to the infant tray; and locking the plurality of supports to inhibit vertical adjustment with respect to the ring.

13. A method of constructing an infant activity center, the method comprising the steps of:

mounting a plurality of supports to an infant tray, the supports being rotationally and vertically adjustable with respect to the infant tray;

mounting the plurality of supports to a substantially rigid ring having an open interior by coupling each of the supports to a respective polymer mount, where the plurality of supports are rotationally and vertically adjustable with respect to the ring, where the substantially rigid ring has a generally circular shape and comprises a plurality of interconnected segments, each segment forming a portion of the circular shape, and where the polymer mounts are coupled to the substantially rigid ring;

mounting a cushion to the ring to retain the cushion in position with respect to the ring such that the cushion at least partially occupies the open interior of the ring;

orienting the infant tray to substantially overlap the ring and cushion;

locking the plurality of supports to inhibit rotational adjustment with respect to the infant tray; and locking the plurality of supports to inhibit vertical adjustment with respect to the ring.

* * * * *